US010174643B2

(12) United States Patent
Son et al.

(10) Patent No.: US 10,174,643 B2
(45) Date of Patent: Jan. 8, 2019

(54) CONTINUOUS VARIABLE VALVE DURATION APPARATUS AND ENGINE PROVIDED WITH THE SAME

(71) Applicants: Hyundai Motor Company, Seoul (KR); Kia Motors Corporation, Seoul (KR)

(72) Inventors: You Sang Son, Suwon-si (KR); Ingee Suh, Yongin-si (KR); Kiyoung Kwon, Yongin-si (KR); In Sang Ryu, Incheon (KR); Kyoung Pyo Ha, Seongnam-si (KR); Dongheon Park, Seongnam-si (KR); Wootae Kim, Anyang-si (KR); Back Sik Kim, Osan-si (KR); Seung Jae Lee, Bucheon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/806,153

(22) Filed: Nov. 7, 2017

(65) Prior Publication Data

US 2018/0171834 A1 Jun. 21, 2018

(30) Foreign Application Priority Data

Dec. 15, 2016 (KR) ..... 10-2016-0171930

(51) Int. Cl.
*F01L 1/34* (2006.01)
*F01L 1/344* (2006.01)
(Continued)

(52) U.S. Cl.
CPC ..... *F01L 1/34413* (2013.01); *F01L 1/047* (2013.01); *F01L 1/267* (2013.01); *F01L 1/356* (2013.01); *F01L 2001/0473* (2013.01)

(58) Field of Classification Search
CPC ..... F01L 1/047; F01L 1/267; F01L 1/34413; F01L 2001/0473
(Continued)

(56) References Cited

U.S. PATENT DOCUMENTS 6,382,149 B1 5/2002 Fischer et al.
8,813,704 B2 * 8/2014 Kim ..... F01L 1/0532 123/90.16

FOREIGN PATENT DOCUMENTS

JP 2016-109120 A 6/2016
KR 10-1684559 B1 12/2016

OTHER PUBLICATIONS

European Search Report dated May 22, 2018 for corresponding European Patent Application No. 17200815.3, 6 pages.

* cited by examiner

*Primary Examiner* — Ching Chang
(74) *Attorney, Agent, or Firm* — Morgan, Lewis & Bockius LLP

(57) ABSTRACT

A continuous variable valve duration apparatus may include a camshaft, a cam device on which a cam is formed, of which the camshaft is inserted thereto and of which a relative phase angle with respect to the camshaft is variable, an internal bracket transmitting rotation of the camshaft to the cam device, a wheel housing in which the internal bracket is rotatably inserted and on which a guide groove parallel to the camshaft is formed, a control portion including a control shaft disposed parallel to the camshaft and inserted into the guide groove, and the control portion selectively rotating the control shaft for the relative position of the wheel housing with respect to the camshaft to be changed and a slider housing interposed between the control shaft and the guide groove.

20 Claims, 20 Drawing Sheets

(51) Int. Cl.
*F01L 1/047* (2006.01)
*F01L 1/26* (2006.01)
*F01L 1/356* (2006.01)

(58) Field of Classification Search
USPC ..... 123/90.15, 90.16, 90.17, 90.18
See application file for complete search history.

CONTINUOUS VARIABLE VALVE DURATION APPARATUS AND ENGINE PROVIDED WITH THE SAME

CROSS-REFERENCE TO RELATED APPLICATION

The present application claims priority to Korean Patent Application No. 10-2016-0171930 filed on Dec. 15, 2016, the entire contents of which is incorporated herein for all purposes by this reference.

BACKGROUND OF THE INVENTION

Field of the Invention

The present invention relates to a continuous variable valve duration apparatus and an engine provided with the same. More particularly, the present invention relates to a continuous variable valve duration apparatus an engine provided with the same which may vary the opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a continuous variable valve duration apparatus and an engine provided with the same which may vary the opening duration of a valve according to operation conditions of an engine, with a simple construction.

A continuous variable valve duration apparatus according to an exemplary embodiment of the present invention may include a camshaft, a cam device on which a cam is formed, of which the camshaft is inserted thereto and of which a relative phase angle with respect to the camshaft is variable, an internal bracket transmitting rotation of the camshaft to the cam device, a wheel housing in which the internal bracket is rotatably inserted and on which a guide groove parallel to the camshaft is formed, a control portion including a control shaft disposed parallel to the camshaft and inserted into the guide groove, and the control shaft selectively rotating the control shaft for the relative position of the wheel housing with respect to the camshaft to be changed and a slider housing interposed between the control shaft and the guide groove.

A guide hole vertical to the camshaft may be formed at the wheel housing, and the continuous variable valve duration apparatus may further include a guide portion including a guide shaft inserted into the guide hole for guiding movement of the wheel housing.

The guide portion may further include a guide bracket supporting the guide shaft.

The slider housing may be made of nonmetal material.

An oil supply hole may be formed at the slider housing.

A cross section of the slider housing may be shaped as "U" shape.

Both end portions of the slider housing may be further extended than a center of the control shaft for the slider housing not to be separated from the control shaft.

A sliding portion inserted into the slider housing may be formed at the control shaft.

A connection groove may be formed at the sliding portion for the slider housing not to be separated.

A slider housing protrusion inserted into the connection groove may be formed at an internal side of the slider housing.

A first sliding hole and a second sliding hole may be formed to the internal bracket respectively and a cam slot may be formed at the cam device, and the continuous variable valve duration apparatus may further include a slider pin connected to the camshaft and rotatably inserted into the first sliding hole and a roller cam slidably inserted into the cam slot and rotatably inserted into the second sliding hole.

The roller cam may include a roller cam body slidably inserted into the cam slot, a cam head rotatably inserted into the second sliding hole and a protrusion for preventing the roller cam from being separated.

The slider pin may include a pin body slidably inserted into the camshaft and a pin head rotatably inserted into the first sliding hole.

A camshaft oil hole may be formed within the camshaft along a longitudinal direction thereof, a body oil hole communicating with the camshaft oil hole may be formed at the pin body of the slider pin and an oil groove communicating with the body oil hole may be formed at the pin head of the slider pin.

The cam device may include a first cam portion and a second cam portion which are disposed corresponding to a cylinder and a neighboring cylinder respectively and the internal bracket may include a first internal bracket and a second internal bracket transmitting rotation of the camshaft to the first cam portion and the second cam portion respectively.

The continuous variable valve duration apparatus may further include a bearing disposed within the wheel housing for supporting the first internal bracket and the second internal bracket.

Two cams may be formed at the first cam portion and the second cam portion and a cam connecting portion may be formed between the cams, and the continuous variable valve duration apparatus may further include a cam cap on which a cam supporting portion supporting the cam connecting portion is formed.

The continuous variable valve duration apparatus may further include a cam cap rotatably supporting the cam device and a guide bracket supporting the guide shaft and connected to the cam cap.

The continuous variable valve duration apparatus further include a first journal and a second journal connected to the control shaft and a journal bracket rotatably supporting the first journal and the second journal, and the journal bracket may be mounted to the cam cap.

An engine according to an exemplary embodiment of the present invention may be provided with the continuous variable valve duration apparatus.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus an entire height of a valve train may be reduced.

Since the continuous variable valve duration apparatus may be applied to a conventional engine without excessive modification, thus productivity may be enhance and production cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
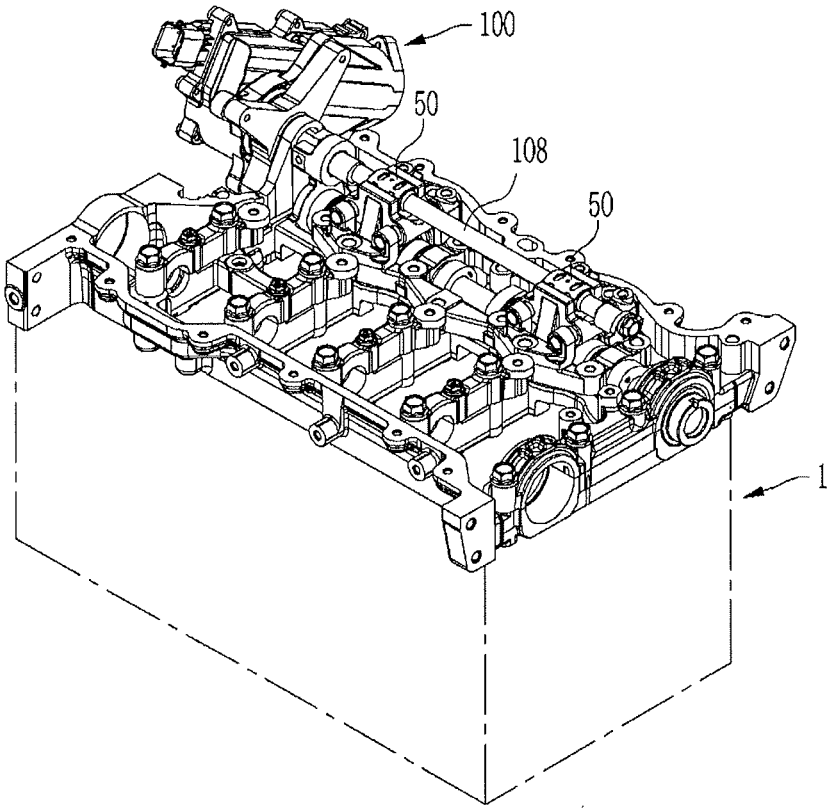
FIG. 1 is a perspective view of an engine provided with a continuous variable valve duration apparatus according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
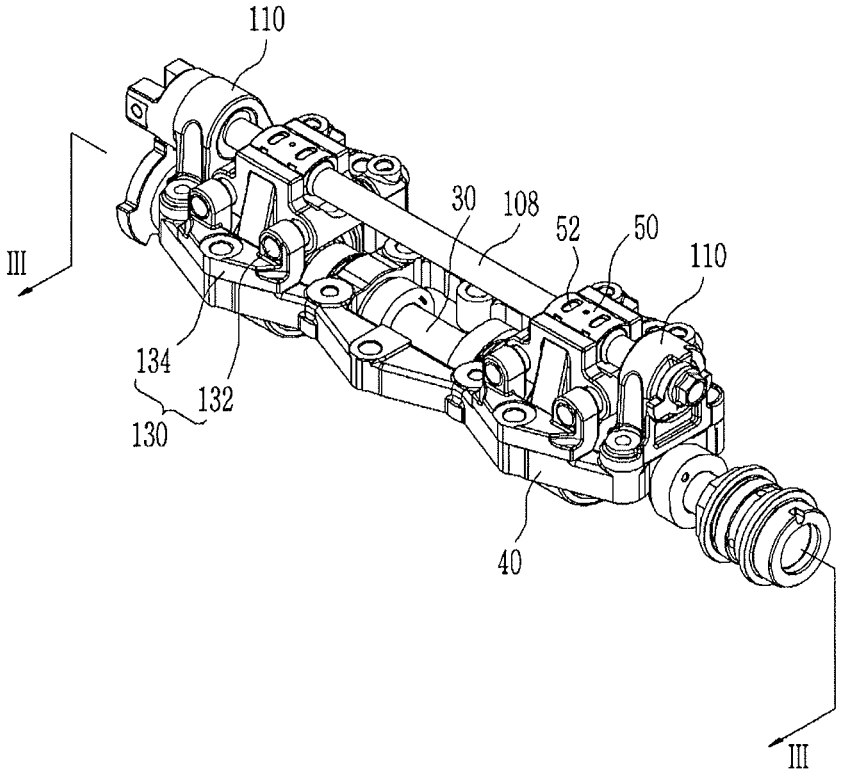
FIG. 2 is a perspective view of a continuous variable valve duration apparatus according to an exemplary embodiment of the present invention.

FIG. 1 is a perspective view of an engine provided with a continuous variable valve duration apparatus according to an exemplary embodiment of the present invention and FIG. 2 is a perspective view of a continuous variable valve duration apparatus according to an exemplary embodiment of the present invention.

Figure 3:
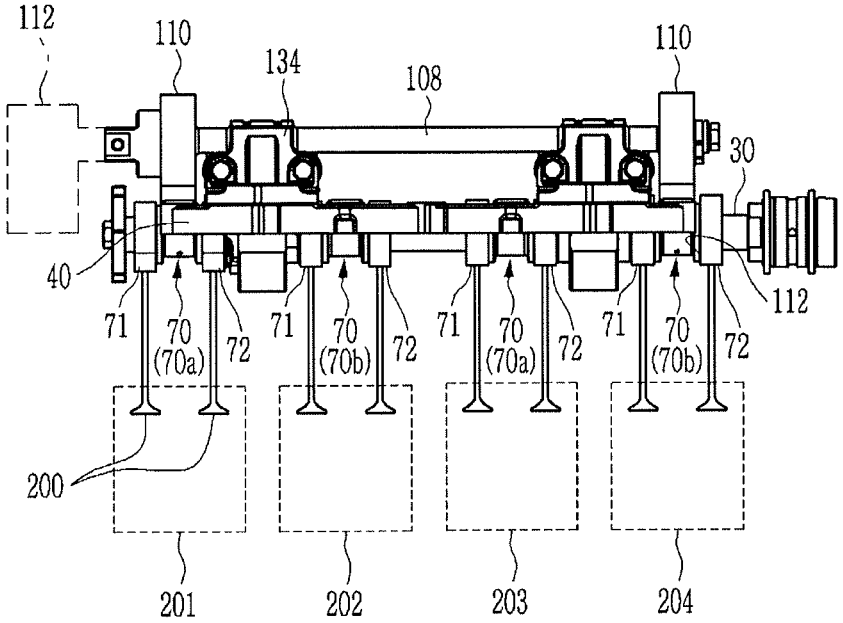
FIG. 3 is a partial side view of a continuous variable valve duration apparatus according to an exemplary embodiment of the present invention.
Figure 4:
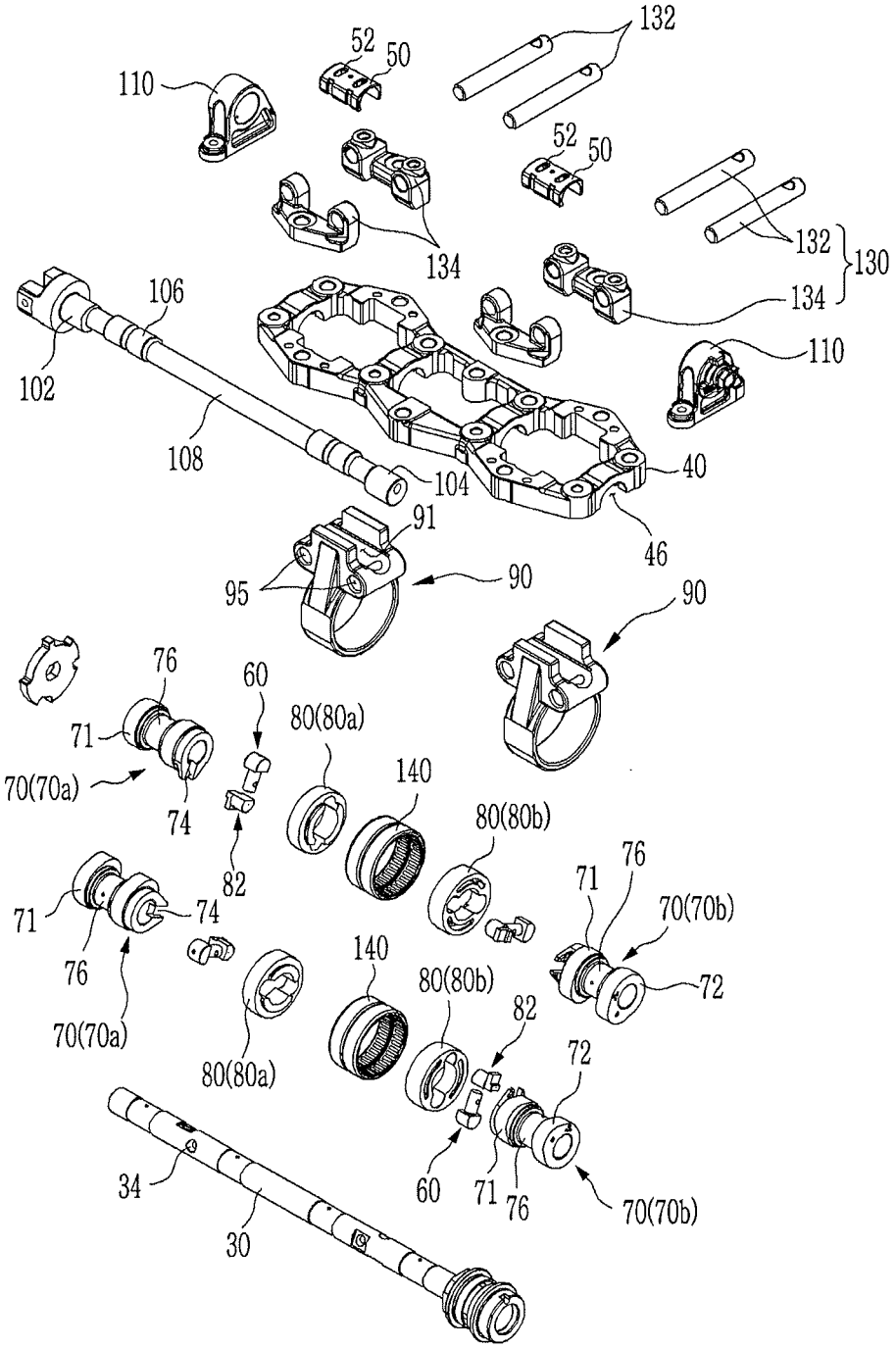
FIG. 4 is an exploded perspective view of a continuous variable valve duration apparatus according to an exemplary embodiment of the present invention.

FIG. 3 is a partial side view of a continuous variable valve duration apparatus according to an exemplary embodiment of the present invention and FIG. 4 is an exploded perspective view of a continuous variable valve duration apparatus according to an exemplary embodiment of the present invention.

Figure 5:
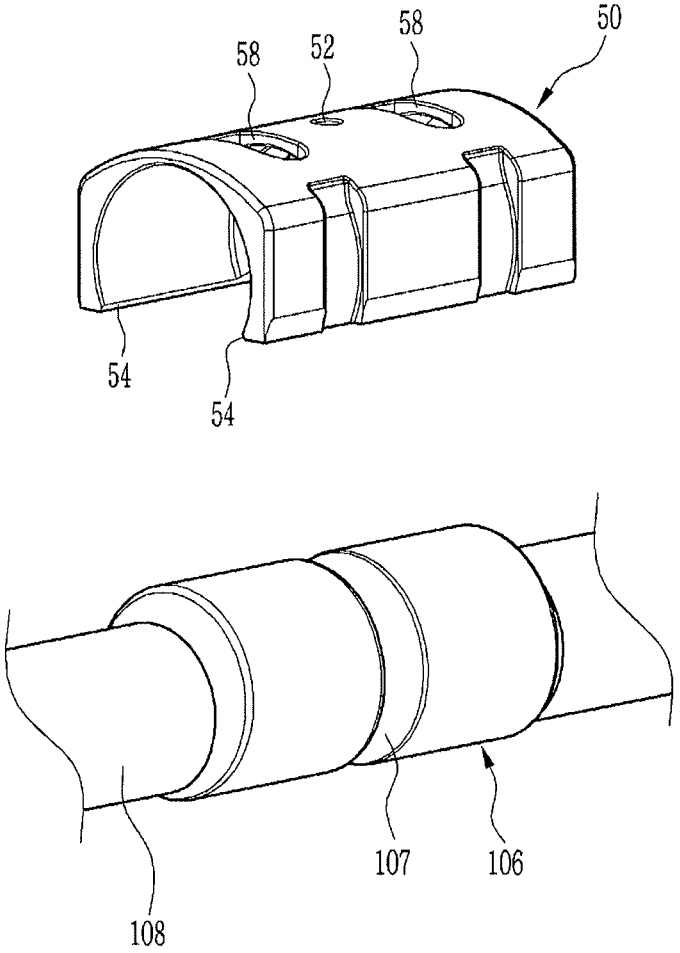
FIG. 5 is a perspective view of a slider housing and a sliding portion of a continuous variable valve duration apparatus according to an exemplary embodiment of the present invention.
Figure 6:
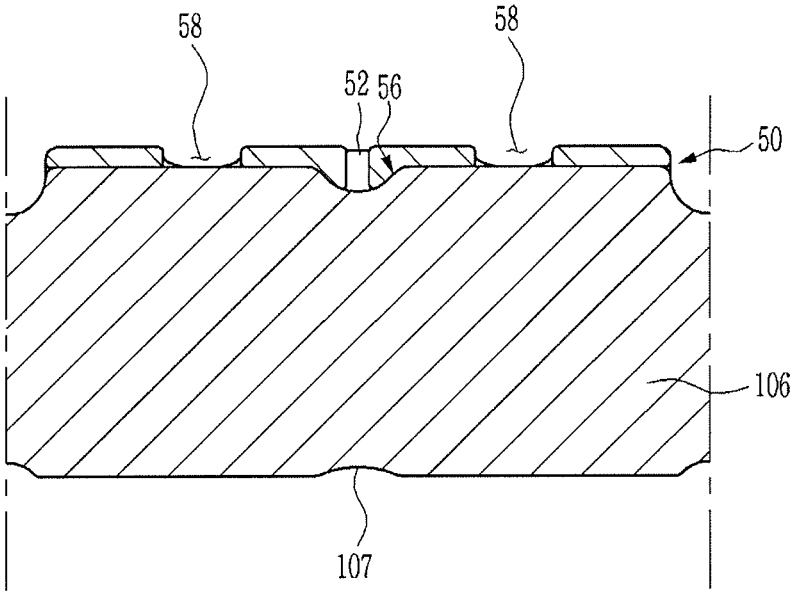
FIG. 6 and FIG. 7 are cross-sectional views of a slider housing of a continuous variable valve duration apparatus according to an exemplary embodiment of the present invention.
Figure 7:
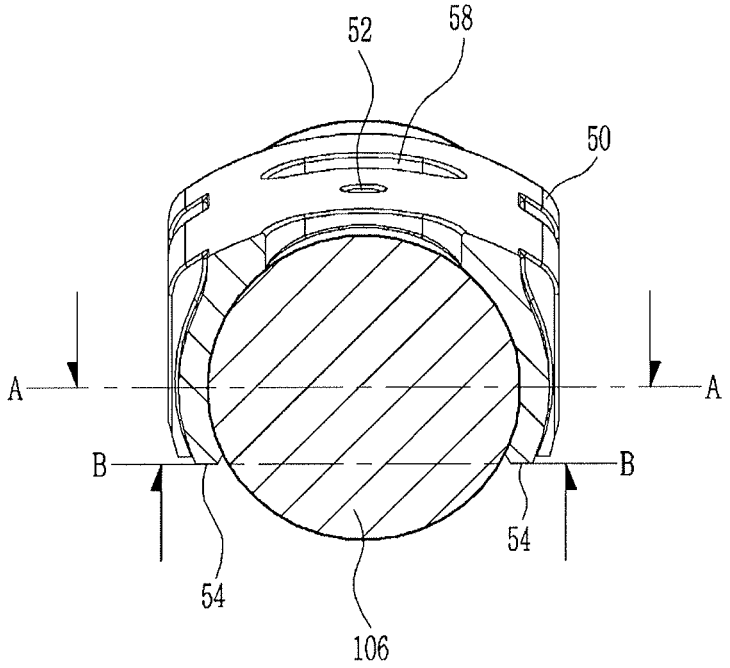

FIG. 5 is a perspective view of a slider housing and a sliding portion of a continuous variable valve duration apparatus according to an exemplary embodiment of the present invention and FIG. 6 and FIG. 7 are cross-sectional views of a slider housing of a continuous variable valve duration apparatus according to an exemplary embodiment of the present invention.

Figure 8:
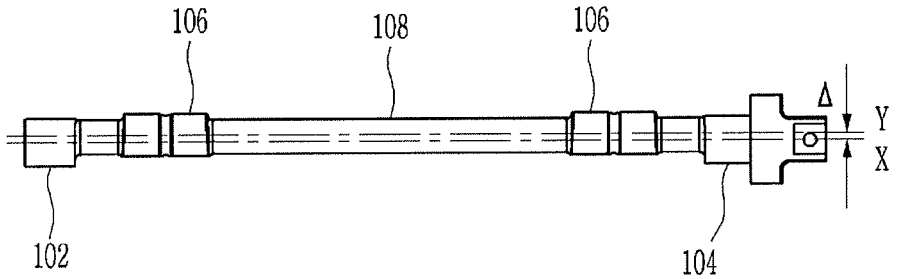
FIG. 8 is a drawing showing a control shaft of a continuous variable valve duration apparatus according to an exemplary embodiment of the present invention.
Figure 9:
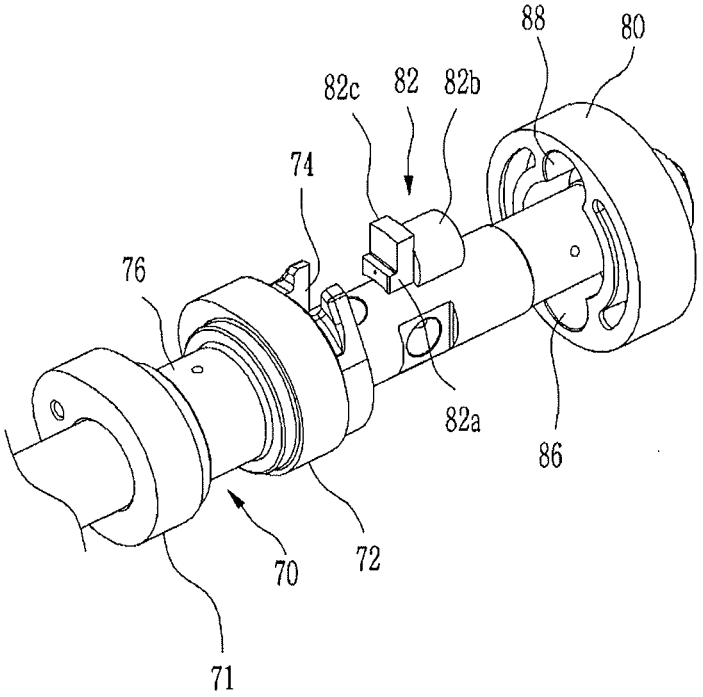
FIG. 9 is an exploded perspective view showing and internal bracket and a cam device of a continuous variable valve duration apparatus according to an exemplary embodiment of the present invention.

FIG. 8 is a drawing showing a control shaft of a continuous variable valve duration apparatus according to an exemplary embodiment of the present invention and FIG. 9 is an exploded perspective view showing and internal bracket and a cam device of a continuous variable valve duration apparatus according to an exemplary embodiment of the present invention.

Figure 10:
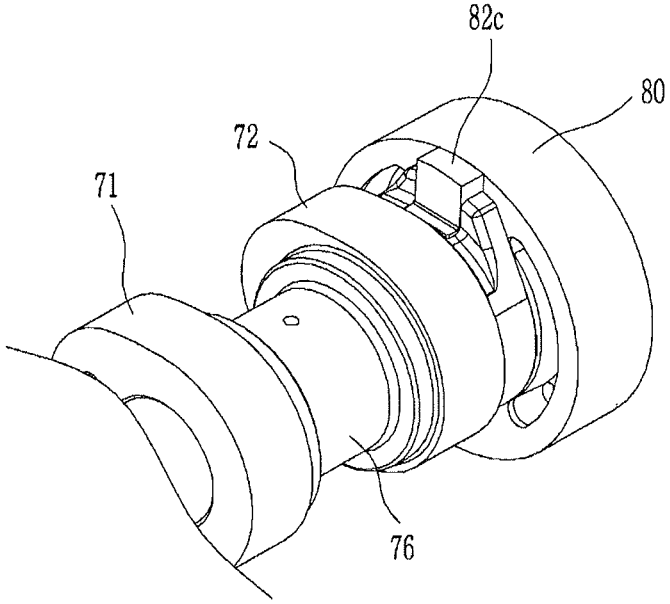
FIG. 10 is a perspective view showing an internal bracket and a cam device of a continuous variable valve duration apparatus according to an exemplary embodiment of the present invention.

FIG. 10 is a perspective view showing an internal bracket and a cam device of a continuous variable valve duration apparatus according to an exemplary embodiment of the present invention.

Referring to FIG. 1 to FIG. 10, an engine 1 according to an exemplary embodiment of the present invention includes a continuous variable valve duration apparatus mounted to the cylinder head.

In the drawing, 4 cylinders 211, 212, 213 and 214 are formed at the engine, but it is not limited thereto.

The continuous variable valve duration apparatus according to an exemplary embodiment of the present invention may include a camshaft 30, a cam device 70 on which a cam 71 is formed, of which the camshaft 30 is inserted thereto and of which a relative phase angle with respect to the camshaft 30 is variable, an internal bracket 80 transmitting rotation of the camshaft 30 to the cam device 70, a wheel housing 90 in which the internal bracket 80 is rotatably inserted and on which a guide groove 91 parallel to the camshaft 30 is formed, a control portion 100 including a control shaft 108 disposed parallel to the camshaft 30 and inserted into the guide groove 91, and the control portion 100 selectively rotating the control shaft 108 for the relative position of the wheel housing 90 with respect to the camshaft 30 to be changed and a slider housing 50 interposed between the control shaft 108 and the guide groove 91.

The camshaft 30 may be an intake camshaft or an exhaust camshaft.

A guide hole 95 vertical to the camshaft 30 is formed at the wheel housing 90, and the continuous variable valve duration apparatus further includes a guide portion 130 including a guide shaft 132 inserted into the guide hole 95 for guiding movement of the wheel housing 90.

The guide portion 130 further includes a guide bracket 134 supporting the guide shaft 132.

The slider housing 50 may be made of nonmetal material and the guide groove 91 and the control shaft 108 may be formed of metal material.

Since the metallic guide groove 91 and the metallic the control shaft 108 are not directly contacted, and thus impact, noise, vibration, abrasion, friction may be prevented.

For example, the slider housing 50 may change metal contact and line contact between the guide groove 91 and the control shaft 108 to metal-nonmetal contact and surface contact among the slider housing 50, the guide groove 91 and the control shaft 108 so that noise, vibration, abrasion and so on may be prevented.

The slider housing 50, for example, may be made of synthetic resin, that is PEEK (Polyether ether ketone) and so on, thus impact, noise, vibration, abrasion, friction due to the guide groove 91 and the control shaft 108 may be prevented.

An oil supply hole 52 is formed at the slider housing 50 and oil may be supplied to the oil supply hole 52. Thus, frictions between the slider housing 50 and the guide groove 91 and between the slider housing 50 and the control shaft 108 may be reduced.

A friction reducing hole 58 may be formed at the slider housing 50 for reducing contacting surface to reduce friction and a portion of scattered oil may be stored in the friction reducing hole 58 so that friction in starting of an engine may be reduced. Also, material for the slider housing 50 may be reduced so that manufacturing cost may be reduced.

A cross section of the slider housing 90 may be shaped as "U" shape, so that the slider housing 50 may be easily inserted between the guide groove 91 and the control shaft 108.

The control portion 100 further includes a control motor 112 selectively rotating the control shaft 108 and a sliding portion 106 inserted into the slider housing 50 is formed at the control shaft 108.

Both end portions 54 of the slider housing 50 may be further extended than a center of the control shaft 108 for the slider housing 50 not to be separated from the control shaft 108. That is, the both end portions 54 of the slider housing 50 is extended to "B" lower than a center A of the sliding portion 106, the slider housing 50 wraps the sliding portion 106 and thus the slider housing 50 may be prevented from being separated from the sliding portion 106.

A connection groove 107 is formed at the sliding portion 106 for the slider housing 50 not to be separated and a slider housing protrusion 56 inserted into the connection groove 107 is formed at an internal side of the slider housing 50.

Thus, the connection groove 107 and the slider housing protrusion 56 may prevent the slider housing 50 from being separated from the sliding portion 106.

The control shaft 108 is connected a first journal 102 and a second journal 104 and a journal bracket 110 rotatably supports the first journal 102 and the second journal 104.

As shown in FIG. 8, a center line Y of the slider portion 106 is offset from a rotation center X of the first journal 102 and the second journal 104.

Figure 11:
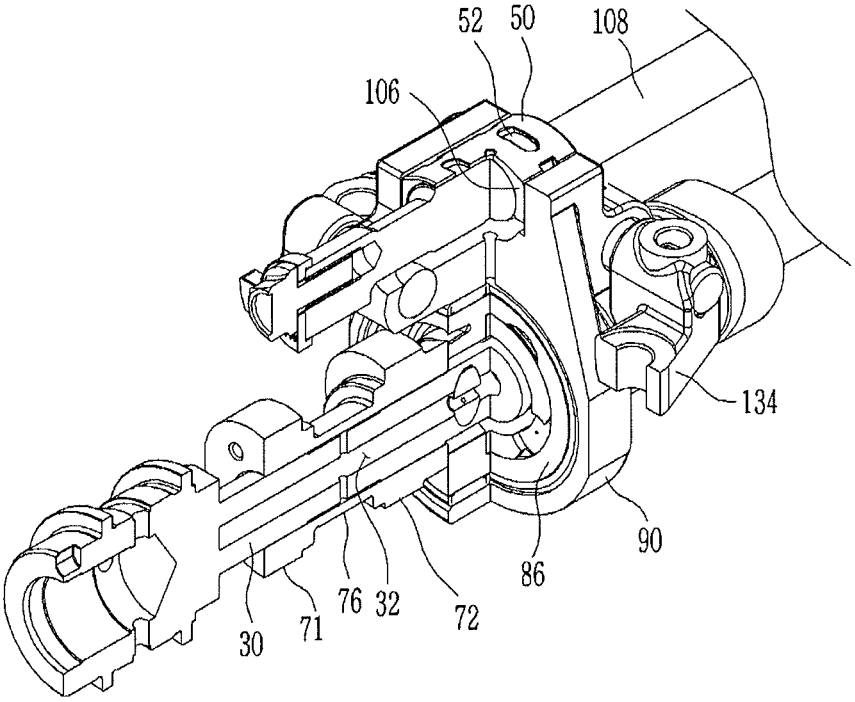
FIG. 11 is a cross-sectional view of a continuous variable valve duration apparatus according to an exemplary embodiment of the present invention.
Figure 12:
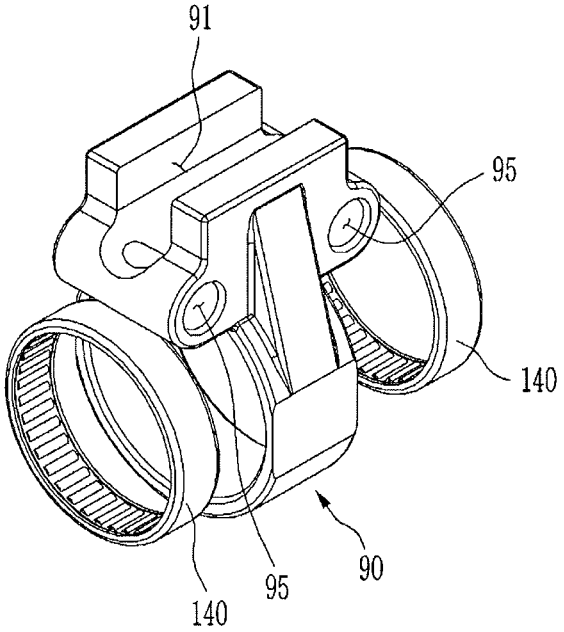
FIG. 12 is an exploded perspective view showing a wheel housing of a continuous variable valve duration apparatus according to an exemplary embodiment of the present invention.

FIG. 11 is a cross-sectional view of a continuous variable valve duration apparatus according to an exemplary embodiment of the present invention and FIG. 12 is an exploded perspective view showing a wheel housing of a continuous variable valve duration apparatus according to an exemplary embodiment of the present invention.

Figure 13:
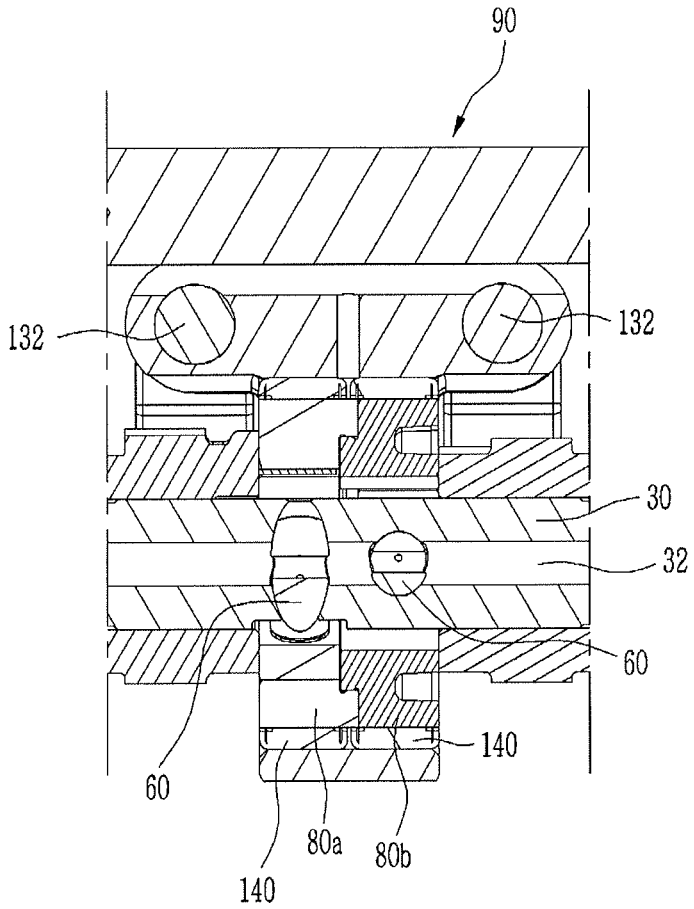
FIG. 13 is a cross-sectional view showing a guide portion and an internal bracket of a continuous variable valve duration apparatus according to an exemplary embodiment of the present invention.
Figure 14:
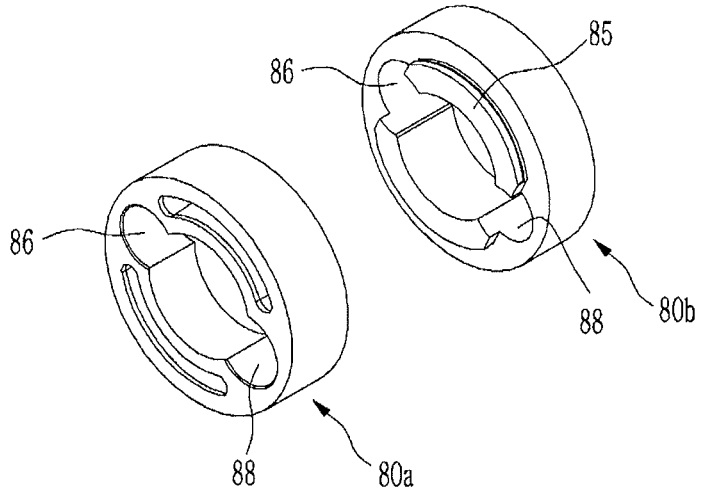
FIG. 14 is an exploded perspective view showing an internal bracket of a continuous variable valve duration apparatus according to an exemplary embodiment of the present invention.

FIG. 13 is a cross-sectional view showing a guide portion and an internal bracket of a continuous variable valve duration apparatus according to an exemplary embodiment of the present invention and FIG. 14 is an exploded perspective view showing an internal bracket of a continuous variable valve duration apparatus according to an exemplary embodiment of the present invention.

Figure 15:
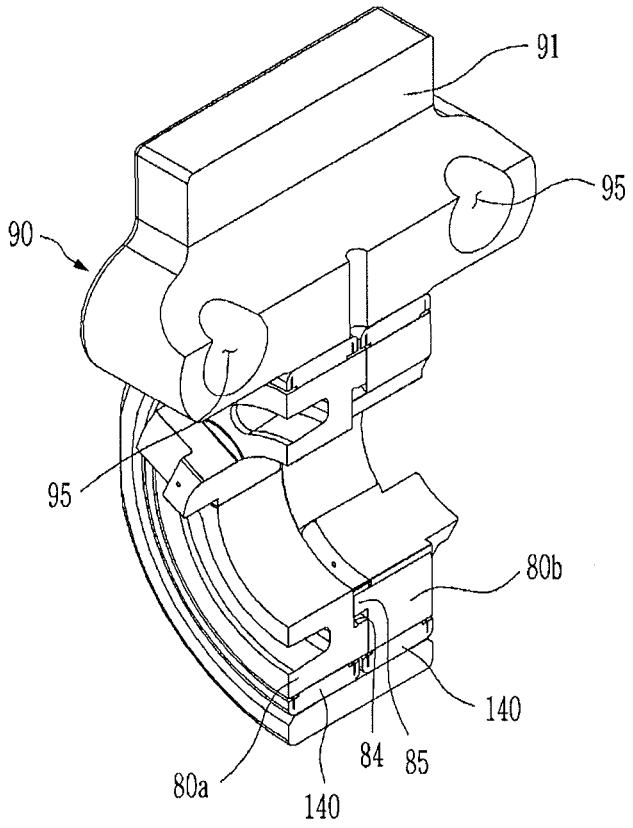
FIG. 15 is a cross-sectional view showing an internal bracket of a continuous variable valve duration apparatus according to an exemplary embodiment of the present invention.

FIG. 15 is a cross-sectional view showing an internal bracket of a continuous variable valve duration apparatus according to an exemplary embodiment of the present invention.

Referring to FIG. 1 to FIG. 15, a first sliding hole 86 and a second sliding hole 88 is formed to the internal bracket 80 respectively and a cam slot 74 is formed at the cam device 70.

The continuous variable valve duration apparatus further includes a slider pin 60 connected to the camshaft 30 and rotatably inserted into the first sliding hole 86 and a roller cam 82 slidably inserted into the cam slot 74 and rotatably inserted into the second sliding hole 88.

The roller cam 82 includes a roller cam body 82*a* slidably inserted into the cam slot 74 and a roller cam head 82*b* rotatably inserted into the second sliding hole 88.

A protrusion 82*c* is formed at the roller cam 82 for preventing the roller cam 82 from being separated from the internal bracket 80 along the longitudinal direction of the cam shaft 30.

The slider pin 60 includes a pin body 62 slidably inserted into the camshaft 30 and a pin head 64 rotatably inserted into the first sliding hole 86 and the pin body 62 and the pin head 64 may be formed integrally.

A camshaft hole 34 is formed at the camshaft 30, the pin body 62 of the slider pin 60 is slidably inserted into the camshaft hole 34 and the pin head 64 is rotatably inserted into the first sliding hole 86.

A camshaft oil hole 32 is formed within the camshaft 30 along a longitudinal direction thereof, a body oil hole 66 communicating with the camshaft oil hole 32 is formed at the pin body 62 of the slider pin 60 and an oil groove 68 communicating with the body oil hole 66 is formed at the pin head 64 of the slider pin 60.

Thus, lubricant supplied to the camshaft oil hole 32 may be supplied to the internal bracket 80 through the body oil hole 66, the communication hole 69 and the oil groove 68.

The cam device 70 includes a first cam portion 70*a* and a second cam portion 70*b* which are disposed corresponding to a cylinder and a neighboring cylinder respectively, for example the first cylinder 201 and the neighboring second cylinder 202 and the internal bracket 80 includes a first internal bracket 80*a* and a second internal bracket 80*b* transmitting rotation of the camshaft 30 to the first cam portion 70*a* and the second cam portion 70*b* respectively.

The continuous variable valve duration apparatus further includes a bearing 140 disposed within the wheel housing 90 for supporting the first internal bracket 80*a* and the second internal bracket 80*b*.

The bearing 140 may be a needle bearing, the first and the second internal brackets 80*a* and 80*b* are disposed within a wheel housing 90 and the bearing 140 may rotatably support the first and the second internal brackets 80*a* and 80*b*.

Since the first and the second internal brackets 80*a* and 80*b* are disposed within a wheel housing 90, element numbers may be reduced, so that productivity and manufacturing economy may be enhanced.

The first internal bracket 80*a* and the second internal bracket 80*b* within the wheel housing 90 may be connected each other.

For example, a first internal bracket connecting portion 84 and a second internal bracket connecting portion 85 are formed at the first internal bracket 80*a* and the second internal bracket 80*b* respectively, and the first internal bracket connecting In the drawing, the first internal bracket connecting portion 84 and the second internal bracket connecting portion 85 are formed as convex and concave, it is not limited thereto.

In the case that the first internal bracket 80*a* and the second internal bracket 80*b* are connected, looseness or vibration due to manufacturing tolerances of the bearing, the internal bracket, the wheel housing and so on may be reduced.

Two cams 71 and 72 may be formed on the first and the second cam portions 70*a* and 70*b* as a pair and a cam cap connecting portion 76 is formed between the paired cams 71 and 72 of each of the first and second cam portions 70*a* and 70*b*.

The cam 71 and 72 rotate and open the valve 200.

The continuously variable valve duration apparatus further includes a cam cap 40 on which a cam supporting portion 46 configured to rotatably support the cam cap connecting portion 76 is formed on the cam cap 40.

The guide bracket 134 is connected to the cam cap 40 rotatably supporting the cam connecting portion 76 of the cam device 70.

Also, the journal bracket 110 is connected to the cam cap 40, so that assemble process and maintenance of a vehicle may be easily performed.

Figure 16:
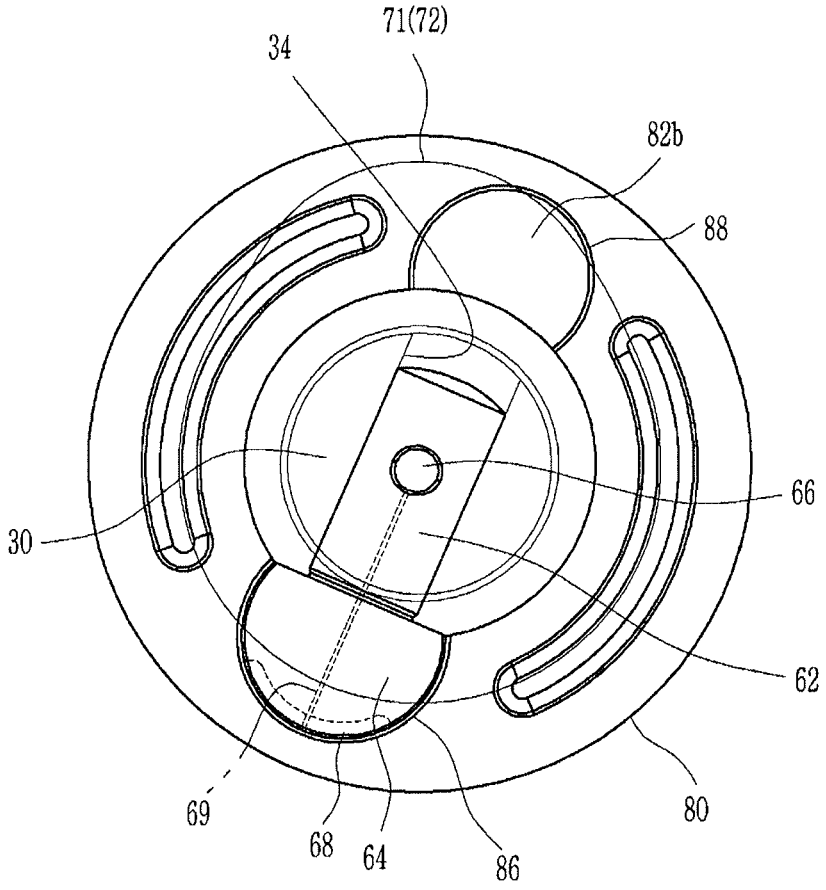
FIG. 16, FIG. 17, and FIG. 18 are drawings showing operations of a continuous variable valve duration apparatus according to an exemplary embodiment of the present invention.
Figure 17:
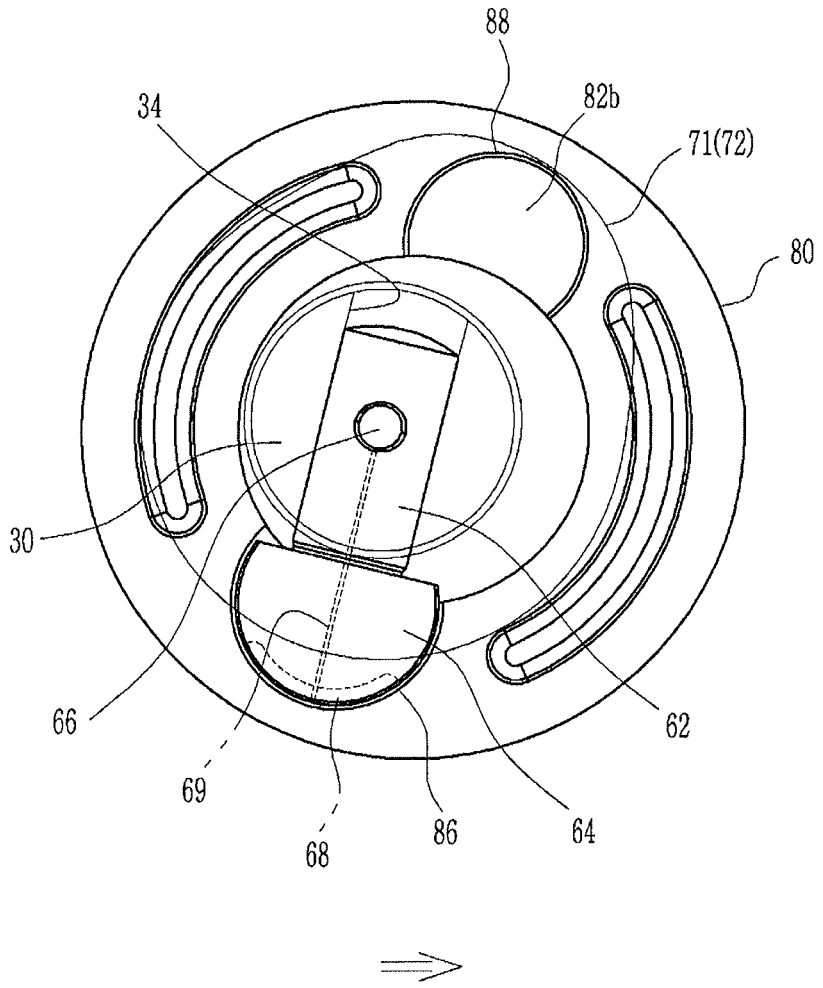
Figure 18:
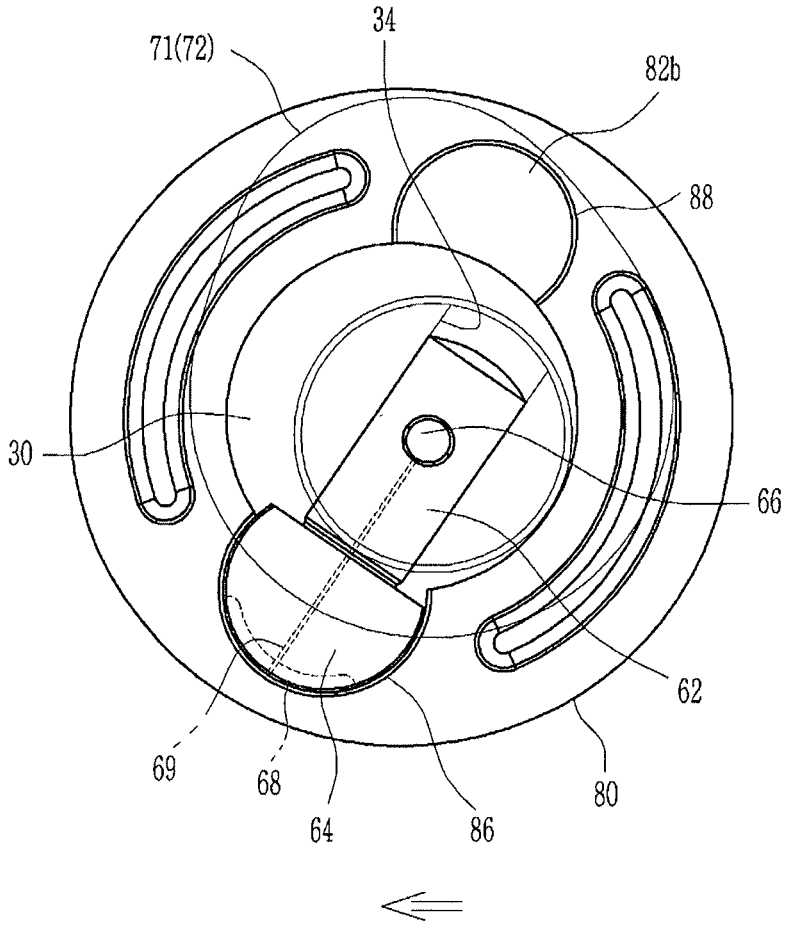

FIG. 16, FIG. 17, and FIG. 18 are drawings showing operations of a continuous variable valve duration apparatus according to an exemplary embodiment of the present invention.

As shown in FIG. 16, when rotation centers of the camshaft 30 and the cam device 70 are coincident, the cams 71 and 72 rotate with the same phase angle of the camshaft 30.

According to engine operation states, an ECU (engine control device or electric control unit) transmits control signals to the control portion 100, then the control motor 112 rotates the control shaft 108.

As shown in FIG. 17 and FIG. 18, a relative position of the wheel housing 90 with respect to the camshaft 30 is changed due to rotation of the control shaft 108.

When the relative position of the wheel housing 90 with respect to the camshaft 30 is changed, the relative rotation speed of the cams 71 and 72 with respect to the rotation speed of the camshaft 30 is changed.

While the slider pin 60 is rotated with the camshaft 30, the pin body 62 is slidable within the camshaft hole 34, the pin head 64 is rotatable within the first sliding hole 86, and the roller cam 82 is rotatably within the second sliding hole 88 and slidable within the cam slot 74. Thus, the relative rotation speed of the cams 71 and 72 with respect to the rotation speed of the camshaft 30 is changed.

Figure 19:
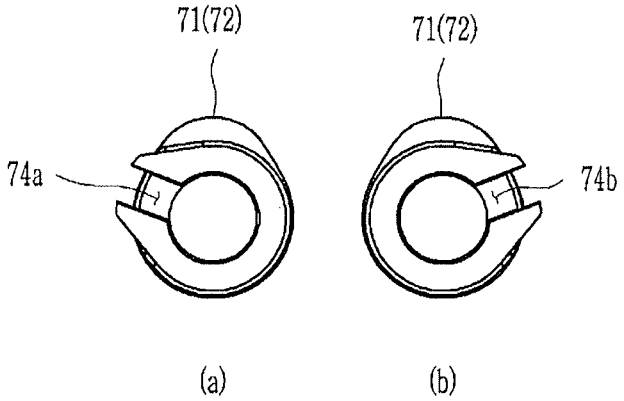
FIG. 19 is a drawing showing a cam slot of a continuous variable valve duration apparatus according to an exemplary embodiment of the present invention.
Figure 20:
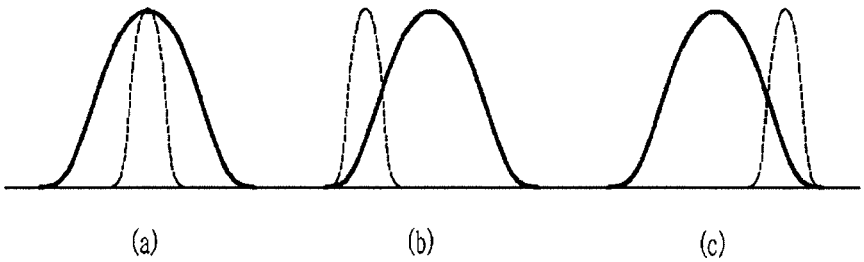
FIG. 20 is a graph showing valve profile of a continuous variable valve duration apparatus according to an exemplary embodiment of the present invention.

FIG. 19 is a drawing showing a cam slot of a continuous variable valve duration apparatus according to an exemplary embodiment of the present invention and FIG. 20 is a graph showing valve profile of a continuous variable valve duration apparatus according to an exemplary embodiment of the present invention.

As shown in FIG. 19, the cam slot 74 may be formed more retarded than a position of the cam 71 or 72 (referring to (74*a*) of FIG. 19) or the cam slot 74 may be formed more advanced than a position of the cam 71 or 72 (referring to (74*b*) of FIG. 19), or the cam slot 74 may be formed with the same phase of the cam 71 or 72. With the above scheme, various valve profiles may be achieved.

Although maximum lift of the valve 200 is constant, however rotation speed of the cam 71 and 72 with respect to the rotation speed of the camshaft 30 is changed according to relative positions of the slider housing 90 so that closing and opening time of the valve 200 is changed. That is, duration of the valve 200 is changed.

According to the relative position of the cam slot 74, mounting angle of the valve 200 and so on, opening or closing time of the valve may be simultaneously changed as shown in (a) of FIG. 20.

While opening time of the valve 200 is constant, closing time of the valve 200 may be retarded or advanced as shown (b) of FIG. 20.

While closing time of the valve 200 is constant, opening time of the valve 200 may be retarded or advanced as shown (c) of FIG. 20.

As described above, a continuous variable valve duration apparatus according to an exemplary embodiment of the present invention may achieve various valve duration with a simple construction.

The continuous variable valve duration apparatus according to an exemplary embodiment of the present invention may be reduced in size and thus an entire height of a valve train may be reduced.

Since the continuous variable valve duration apparatus may be applied to a conventional engine without excessive modification, thus productivity may be enhance and production cost may be reduced.

Since the body oil hole 66 and the oil groove 68 are formed at the slider pin 60, lubricant may be smoothly supplied to rotating elements including the internal brackets and so on.

Since shape of the guide groove 91 may be simple, and thus manufacturing process may be simple and manufacturing cost may be reduced.

Since the slider housing 50 is interposed between the guide groove 91 and the control shaft 108 and thus noise, vibration, abrasion and so on may be suppressed.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve duration apparatus comprising:

a camshaft;

a cam device on which a cam is formed, of which the camshaft is configured to be inserted thereto and of which a relative phase angle with respect to the camshaft is variable;

an internal bracket transmitting a rotation of the camshaft to the cam device;

a wheel housing in which the internal bracket is rotatably inserted and on which a guide groove parallel to the camshaft is formed;

a control portion including a control shaft disposed parallel to the camshaft and inserted into the guide groove, and the control portion configured for selectively rotating the control shaft for a relative position of the wheel housing with respect to the camshaft to be changed; and a slider housing interposed between the control shaft and the guide groove.

2. The continuous variable valve duration apparatus of claim 1, wherein a guide hole vertical to the camshaft is formed at the wheel housing, and wherein the continuous variable valve duration apparatus further includes a guide portion including a guide shaft inserted into the guide hole for guiding a movement of the wheel housing.

3. The continuous variable valve duration apparatus of claim 2, wherein the guide portion further includes a guide bracket supporting the guide shaft.

4. The continuous variable valve duration apparatus of claim 1, wherein the slider housing is made of nonmetal material.

5. The continuous variable valve duration apparatus of claim 1, wherein an oil supply hole is formed at the slider housing.

6. The continuous variable valve duration apparatus of claim 1, wherein a cross section of the slider housing is shaped as "U" shape.

7. The continuous variable valve duration apparatus of claim 6, wherein first and second end portions of the slider housing are further extended than a center of the control shaft for the slider housing not to be separated from the control shaft.

8. The continuous variable valve duration apparatus of claim 1, wherein a sliding portion inserted into the slider housing is formed at the control shaft.

9. The continuous variable valve duration apparatus of claim 8, wherein a connection groove is formed at the sliding portion for the slider housing not to be separated.

10. The continuous variable valve duration apparatus of claim 9, wherein a slider housing protrusion inserted into the connection groove is formed at an internal side of the slider housing.

11. The continuous variable valve duration apparatus of claim 1, wherein a first sliding hole and a second sliding hole are formed at the internal bracket respectively; and a cam slot is formed at the cam device, and, wherein the continuous variable valve duration apparatus further includes:

a slider pin connected to the camshaft and rotatably inserted into the first sliding hole; and a roller cam slidably inserted into the cam slot and rotatably inserted into the second sliding hole.

12. The continuous variable valve duration apparatus of claim 11, wherein the roller cam includes:

a roller cam body slidably inserted into the cam slot;

a cam head rotatably inserted into the second sliding hole; and a protrusion for preventing the roller cam from being separated.

13. The continuous variable valve duration apparatus of claim 11, wherein the slider pin includes:

a pin body slidably inserted into the camshaft; and a pin head rotatably inserted into the first sliding hole.

14. The continuous variable valve duration apparatus of claim 13, wherein a camshaft oil hole is formed within the camshaft along a longitudinal direction thereof;

a body oil hole communicating with the camshaft oil hole is formed at the pin body of the slider pin; and an oil groove communicating with the body oil hole is formed at the pin head of the slider pin.

15. The continuous variable valve duration apparatus of claim 1, wherein the cam device includes a first cam portion and a second cam portion which are disposed corresponding to a cylinder and an adjacent cylinder respectively; and the internal bracket includes a first internal bracket and a second internal bracket transmitting a rotation of the camshaft to the first cam portion and the second cam portion respectively.

16. The continuous variable valve duration apparatus of claim 15, further includes a bearing disposed within the wheel housing for supporting the first internal bracket and the second internal bracket.

17. The continuous variable valve duration apparatus of claim 15, wherein two cams are formed at the first cam portion and the second cam portion; and a cam connecting portion is formed between the cams; and wherein the continuous variable valve duration apparatus further includes a cam cap on which a cam supporting portion supporting the cam connecting portion is formed.

18. The continuous variable valve duration apparatus of claim 1, further including:

a cam cap rotatably supporting the cam device; and a guide bracket supporting the guide shaft and connected to the cam cap.

19. The continuous variable valve duration apparatus of claim 18, further including:

a first journal and a second journal connected to the control shaft; and a journal bracket rotatably supporting the first journal and the second journal, and wherein the journal bracket is mounted to the cam cap.

20. An engine provided with the continuous variable valve duration apparatus of claim 1.

* * * * *